US005865908A

United States Patent [19]

Takei et al.

[11] Patent Number: 5,865,908

[45] Date of Patent: Feb. 2, 1999

[54] COMPOSITE DIFFUSION TYPE NITRIDING METHOD, COMPOSITE DIFFUSION TYPE NITRIDING APPARATUS AND METHOD FOR PRODUCING NITRIDE

[75] Inventors: Masami Takei, Nagaokakyo; Hideto Fujita, Kyoto; Ryoji Fujino, Hikone, all of Japan

[73] Assignees: Shimadzu Mekutemu Kabushiki Kaisya, Otsu; Lihit Seiko Co., Ltd., Kyoto, both of Japan

[21] Appl. No.: 788,796

[22] Filed: Jan. 27, 1997

[51] Int. Cl.[6] ..... C23C 8/24; C23C 8/26

[52] U.S. Cl. ..... 148/230; 148/238; 266/206; 266/209

[58] Field of Search ..... 148/228, 230, 148/231, 238; 266/206, 209

[56] References Cited

U.S. PATENT DOCUMENTS 5,514,225 5/1996 Yamada et al. ..... 148/238

FOREIGN PATENT DOCUMENTS 399925 12/1970 Japan ..... 148/230

583200 12/1977 Russian Federation ..... 148/230

*Primary Examiner*—Deborah Yee

*Attorney, Agent, or Firm*—Kanesaka & Takeuchi

[57] ABSTRACT

A composite diffusion type nitriding method and a composite diffusion type nitriding apparatus of the present invention are effectively used for nitriding various materials, such as machine parts, as well as a material which is difficult for nitriding by a conventional method. The composite diffusion nitriding apparatus is formed of a container filled with solid granular materials, a furnace for housing the container therein, a nitriding gas introduction path for introducing the nitriding gas into the container, and an exhausting path for exhausting the gas from the container. In the method, the material to be nitrided is placed in the solid granular materials, and the nitriding gas is supplied to flow through the solid granular materials to thereby nitride the material.

12 Claims, 11 Drawing Sheets

COMPOSITE DIFFUSION TYPE NITRIDING METHOD, COMPOSITE DIFFUSION TYPE NITRIDING APPARATUS AND METHOD FOR PRODUCING NITRIDE

BACKGROUND OF THE INVENTION AND RELATED ART STATEMENT

The present invention relates to a composite diffusion type nitriding method, a composite diffusion type nitriding apparatus using the same and a method for producing a nitride, which are especially suitable for nitriding tools, such as general tools and molds, which require abrasion resistance, and machine parts and molds made of a material difficult for nitriding, such as austenitic stainless steel.

A nitriding method has generally been known as a surface hardening method of a metal member. The nitriding method has advantages such that since the nitriding method requires a processing temperature lower than that in a hardening method by cementation, less deformation and strain occur in the metal member, and further since an obtained hardening layer is extremely hard, the hardening layer has excellent abrasion resistance and corrosion resistance.

Heretofore, as nitriding methods of this type, a gas nitriding method, salt-bath nitriding method and ion nitriding method have been known. However, in the salt-bath nitriding method, since cyanic salt is used, a working environment is bad and a treatment of a waste liquid requires a huge cost. Thus, the salt-bath nitriding method is not practical. The ion nitriding method using an electric discharging phenomenon in a vacuum condition is hopeful in the future, but there is a limitation in a shape and the like of a material to be nitrided at this stage.

Contrary to these methods, the gas nitriding method has been established as a practical method, and also in the future, it is supposed that the gas nitriding method will take the first place in the nitriding methods. In the gas nitriding method, an ammonia gas is contacted with a surface of heated steel, so that the ammonia gas is decomposed by a catalytic action to form active atomic nitrogen, and active atomic nitrogen is absorbed into the surface of steel to thereby produce nitride with iron contained in steel.

However, the gas nitriding method as described above has the following disadvantages.

First, with respect to a material difficult for nitriding, such as austenitic stainless steel, the nitriding method itself is difficult.

Also, with respect to a material to be nitrided having a special shape, an embrittlement layer (which is also called as white layer or $\epsilon$ layer) and incomplete nitriding are liable to occur. More specifically, with respect to a material to be nitrided having a special shape, such as a tool or mold having a sharp edge, a nitriding effect for the edge portion is accelerated more than other portions having a large mass, so that the edge portion is liable to have an embrittlement layer. The embrittlement layer has a nature of becoming thick in proportion to the thickness of the hardened layer. Therefore, when the hardened layer is made thick, the edge is liable to break off, and abrasion resistance is also decreased.

In order to prevent these defects, in case the embrittlement layer is designed as a portion to be polished beforehand, a polishing work after a nitriding treatment requires a great labor and time, and waste of a material and nitriding gas is increased. On the other hand, with respect to a material to be nitrided having a special shape, such as a machine part with a small hole in a long shaft, since the nitriding gas does not fully enter inside the small hole, the nitriding in the small hole portion may become incomplete. Especially, in case the small hole has one end which is closed, the nitriding is still more difficult.

Furthermore, with respect to not only the material to be nitrided having the above described special shape but also a material to be nitrided having a normal shape, there are problems to be solved as described hereinbelow. First, the gas nitriding itself basically takes a long time, so that a processing efficiency is poor, and it is very difficult to improve an operation rate of a furnace and a cost performance of a product. Thus, a using amount of a nitriding gas is increased. Further, since a slight error in setting various conditions with respect to the nitriding results in a large error accumulated for a long time, and there is another problem in adjusting suppression of an embrittlement layer.

The present invention has been made in view of these problems mentioned above.

An object of the present invention is to provide a composite diffusion type nitriding method for effectively nitriding a material, even for a material difficult for nitriding or having a special shape; and with respect to a material to be nitrided having a normal shape, a stable nitriding layer can be formed by a simple method with high efficiency without imposing severe conditions.

Another object of the present invention is to provide a composite diffusion type nitriding apparatus for effectively nitriding a material with a simple structure.

A further object of the present invention is to provide a method for producing a nitride, which can be simply and effectively prosecuted.

Further objects and advantages of the invention will be apparent from the following description of the invention.

SUMMARY OF THE INVENTION

According to the present invention, a composite diffusion type nitriding method or a method for producing a nitride includes a step of disposing a material to be nitrided in solid granular materials; and a step of supplying a nitriding gas to the solid granular materials to pass therethrough to thereby nitride the material.

Also, according to the present invention, a composite diffusion type nitriding apparatus is formed of a sealed box or container filled with solid granular materials; a furnace for housing the sealed box therein; a nitriding gas introduction path for introducing a nitriding gas into the sealed box; and an exhausting path for exhausting the gas in the sealed box.

As a preferable embodiment of the present invention, the nitriding gas introduction path is connected to the sealed box at plural portions spaced apart from each other to selectively introduce the nitriding gas into the sealed box from the different positions. Also, the exhausting path is connected to the sealed box at plural portions spaced apart from each other to selectively exhaust the gas in the sealed box from the different positions.

In order to increase pressure resistance of the sealed box, it is effective to provide in the apparatus an inert gas introduction path for introducing an inert gas into the furnace.

DETAILED DESCRIPTION OF THE PREFERRED EMBODIMENTS

Figure 1:
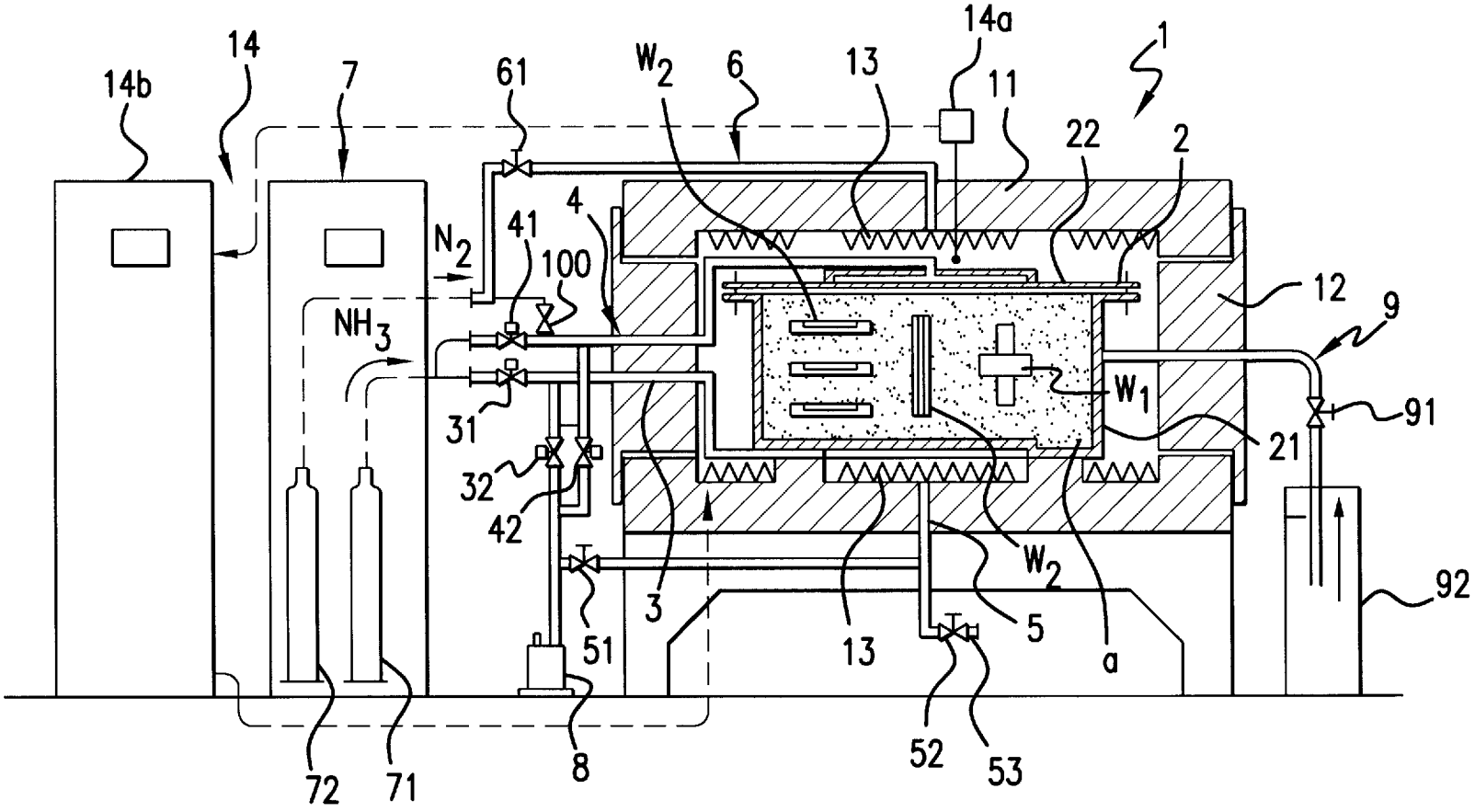
FIG. 1 is a diagram of an embodiment of the present invention.

Referring to the drawings, an embodiment of the present invention is described hereunder.

FIG. 1 is a diagram for showing a composite diffusion type nitriding apparatus of an embodiment according to the present invention. The composite diffusion type nitriding apparatus is structured such that first and second gas discharge-introduction pipes 3, 4 functioning as nitriding gas supplying and discharging paths are connected to a sealed box 2 inserted into a heating furnace 1, and a gas discharge pipe 5 as another discharging path and a gas introduction pipe 6 as another inactive gas introducing path are connected to a furnace body 11 of the heating furnace 1.

More specifically, in the heating furnace 1, a door 12 is provided at an opening portion with a hinge, which is formed at at least a part of the heat insulating furnace body 11. When the door 12 is opened to release or open the furnace body 11, the sealed box 2 can be inserted thereinto or taken out therefrom, and when the door 12 is closed, the furnace body 11 can be airtightly sealed. A heater 13 as a heating source is provided at a position surrounding the sealed box 2 in the furnace body 11, and the heater 13 receives electricity from a temperature adjusting device 14 provided outside the furnace to thereby heat the sealed box 2. The temperature adjusting device 14 is formed of a temperature sensor 14*a* having a detecting portion in the furnace 1, and a temperature adjusting board 14*b* for receiving a detected signal from the temperature sensor 14*a* and feed-back controlling the heater 13 so that the detected temperature is maintained at a predetermined temperature.

Figure 2:
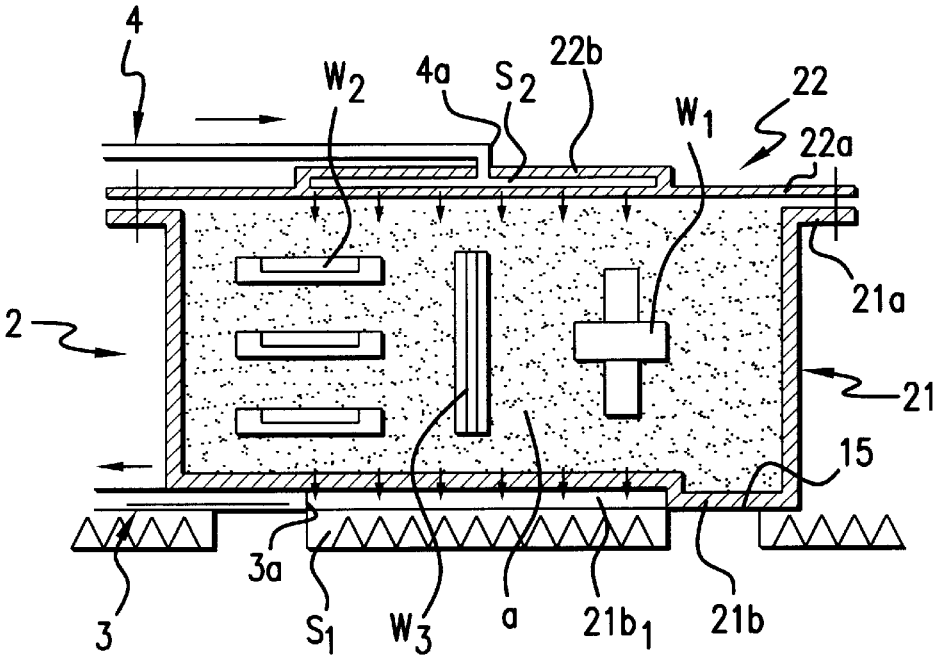
FIG. 2 is a view showing an essential part and functions of the same embodiment.

The sealed box 2, as shown in FIGS. 1 and 2, is formed of a box body 21 having an opening flange 21*a* at an upper part thereof, and a lid 22 detachably provided to the opening flange 21*a* of the box body 21. An escape groove $\mathbf{21}b_1$ is formed for a certain length at a central portion in a width direction of a bottom plate 21*b* of the box body 21, and a plurality of small holes penetrating in a thickness direction is provided to the escape groove $\mathbf{21}b_1$. The bottom plate 21*b* of the box body 21 is mounted on projections 15 as a hearth provided at a lower portion of the heating furnace 1 to surround therearound. At this time, the inner circumferences of the projections 15 are closed by bottom portions other than the escape groove 21*b*, and in an inner portion, a flat and closed first gas introduction-discharge space $S_1$ is formed. The gas introduction-discharge space $S_1$ is communicated with an interior of the sealed box 2 through the small holes.

On the one hand, the lid 22 is formed of a lid main portion 22*a* and an auxiliary lid 22*b* mounted on the lid main portion 22*a*, and a flat and closed second gas introduction-discharge space $S_2$ is formed between the lid main portion 22*a* and the auxiliary lid 22*b*. The lid main portion 22*a* is provided with a plurality of small holes in its thickness direction, and through the small holes, the second gas discharge-introduction space $S_2$ is communicated with the interior of the sealed box 2.

In the first gas discharge-introduction pipe 3, one end 3*a* is inserted into the first gas discharge-introduction space $S_1$ along the bottom plate 21*b* of the sealed box body 21 without interference with the bottom plate 21*b*, and the other end airtightly penetrates the furnace body 11 and is extended to an outside of the heating furnace 1. In the second gas discharge-introduction pipe 4, one end 4*a* is connected to the auxiliary lid 22*b* to thereby communicate with the interior of the second gas discharge-introduction space $S_2$, and the other end airtightly penetrates the furnace body 11 and is extended to an outside of the heating furnace 1. The respective other ends of the gas discharge-introduction pipes 3, 4 are branched, wherein each one end of the branches is connected to an $NH_3$ filling cylinder 71 as a nitriding gas source through valves 31, 41, and each other end of the branches is connected to a vacuum pump 8 through valves 32, 42.

In the gas discharge pipe 5, one end is inserted into the interior of the furnace body 11, and the other end is branched into two, one of which is connected to the vacuum pump 8 through a valve 51 and the other of which is opened in an atmosphere through a gas discharging pipe 53.

In the gas introduction pipe 6, one end is inserted into the interior of the furnace body 11, and the other end is connected to an $N_2$ filling cylinder 72 as an inert gas source through a valve 61. Another gas pipe branched from the gas introduction pipe 6 is connected to the interior of the sealed box 2, and in this gas pipe, a valve 100 is provided.

Incidentally, one end of a nitriding gas discharge pipe 9 is connected to a side wall of the sealed box 2, and the other end penetrates the furnace body 11 and is connected to a nitriding gas protection device 92 provided outside the furnace through a valve 91. The nitriding gas protection device 92 releases the nitriding gas discharged from the sealed box 2 into water, and after gaseous ammonia is absorbed, the reminder is released in the atmosphere. Reference numeral 7 denotes a gas control board for controlling a gas supply amount from the cylinder 71 to obtain a desired decomposition rate.

Figure 4:
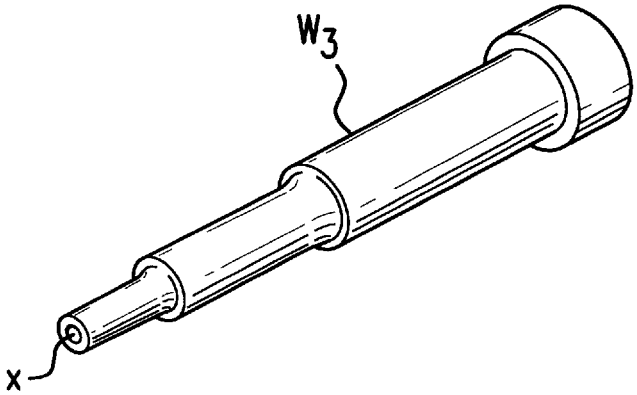
FIG. 4 is a perspective view of a treated material $W_3$ in the same embodiment.

Hereinunder, a nitriding process in the present embodiment is explained. First, outside the furnace, solid granular materials a are filled into the sealed box 2. In case a nitriding effect varies depending on a particle size, the particle size is also adjusted beforehand. More specifically, normally, although it is desirable that a diameter of the solid granular material is several hundreds of microns and a void ratio is about 20%, these numeral values may be changed depending on the purposes and usages thereof. Then, materials $W_1$–$W_3$ to be nitrided are buried in the solid granular materials. The $W_1$ is SUS 304 stainless steel; the $W_2$ is SKD 61 hot tool steel; and the $W_3$ is powder-formed high speed tool steel. The $W_3$ has, as shown in FIG. 4, a non-penetrating hole X with a diameter of 2 mm at a forward end thereof. These materials $W_1$–$W_3$ to be nitrided are placed in the solid granular materials a of the sealed box 2, and the sealed box 2 is inserted into the furnace 1 and is mounted on the projections 15. Then, the lid 12 is closed.

Then, the valves 31, 41 of the gas discharge-introduction pipes 3, 4 are turned off; the valves 32, 42 are turned on; the valve 52 of the gas discharge pipe 5 is turned off; and the valve 51 is turned on. In this condition, the vacuum pump 8 is actuated and the valve 61 of the gas introduction pipe 6 is turned off. Thus, air remaining in the sealed box 2 is withdrawn through the gas discharge-introduction pipes 3, 4 and the gas discharge pipe 5. After a vacuum condition in the sealed box 2 is confirmed, the valves 32, 42 are turned off, the valves 61, 100 are turned on, and the $N_2$ gas is introduced. As a result, the interiors of the furnace 1 and the sealed box 2 are substituted with an inert gas. Incidentally, there may be provided a path for directly exhausting the interior of the furnace 1.

As described hereinabove, after the furnace and the sealed box 2 are substituted with the inert gas, the heater 13 is turned on by the temperature adjusting board 14*b* to raise temperature in the heating furnace 1 and adjust to a predetermined temperature determined by the nitriding condition. In the present embodiment, the temperature in the furnace is adjusted in a range from 400° to 600° C. When the materials $W_1$–$W_3$ to be nitrided are uniformly heated to a predetermined temperature, the valves 32, 41 of the gas discharge-introduction pipes 3, 4 are turned on; the valve 100 is turned off; the valves 31, 42 are turned off; the vale 61 of the gas introduction pipe 6 is turned on; the valve 52 of the gas discharge pipe 53 is turned off; and the valve 91 of the nitriding gas discharge pipe 9 is turned on. This condition is maintained.

Figure 3:
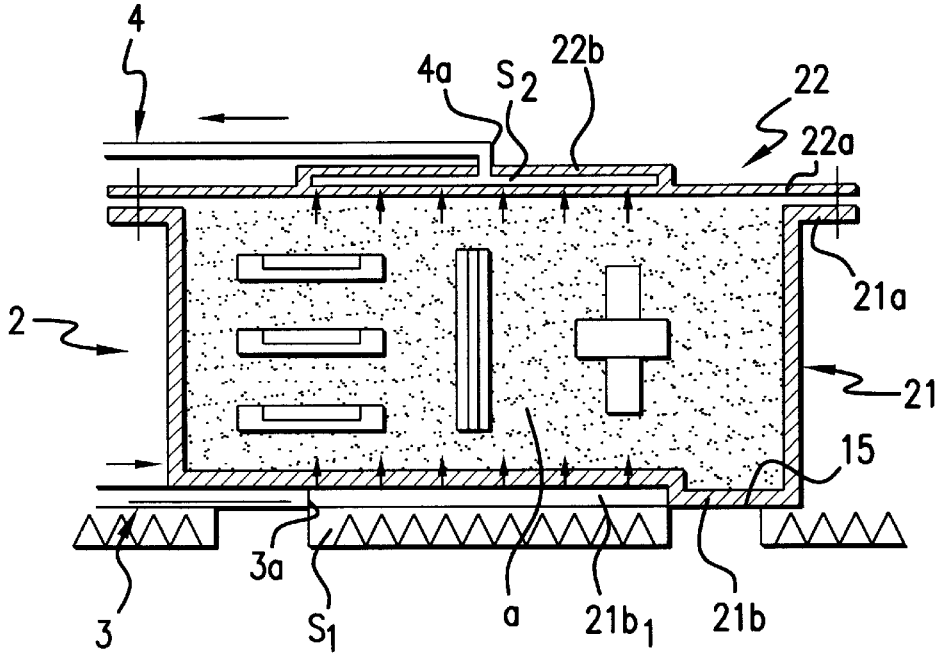
FIG. 3 is a view showing an essential part and functions of the same embodiment.

In this condition, as shown in FIG. 2, the $NH_3$ gas flowing into the second gas discharge-introduction space $S_2$ from the gas discharge-introduction pipe 4 is uniformly diffused into the sealed box 2 through the small holes; flows through the solid granular materials a filled in the sealed box 2 to reach the first gas discharge-introduction space $S_1$ through the small holes provided on an opposite position; and is discharged by the vacuum pump 8 through the first gas discharge-introduction pipe 3. Also, if necessary, after a predetermined time, the valves 32, 41 are turned off and the valves 31, 42 are turned on. As a result, as shown in FIG. 3, there is formed a reverse gas flow, such as the first gas discharge-introduction path 3→the first gas discharge-introduction space $S_1$→the sealed box 2→the second gas discharge-introduction space $S_2$→the second gas discharge-introduction pipe 4. By carrying out the reverse switching of valves as described above, a flow of the gas can be made more uniformly.

In the above process, the flow of the gas is adjusted by the gas control board 7 to thereby control the gas to a certain decomposition ratio and discharge it through the nitriding gas discharging pipe 9 outside the furnace 1. A gas pressure in the furnace 1 is maintained slightly higher than the atmospheric pressure to thereby prevent air from entering thereinto. Also, an $NH_3$ gas pressure in the sealed box 2 is maintained slightly higher than that of the inert gas in an outer circumferential portion to thereby prevent inert gas or air from entering into the sealed box 2.

In the above, although the temperature condition, gas pressure condition, time condition and the like are set according to those in a conventional gas nitriding method, it relates to a particle rate, specific gravity, void rate and the like of the solid granular materials, so that they are properly set to optimum values according to requirements of a material, shape, mass, thickness and hardness of a nitriding hardened layer of the materials $W_1$–$W_3$ to be nitrided finely.

After completion of a predetermined nitriding cycle, the furnace 1 and the sealed box 2 are again substituted with an $N_2$ gas; the lid 12 of the furnace body 11 is opened; the sealed box 2 lowered to a predetermined temperature is taken out from the furnace 1; and the nitrided materials $W_1$–$W_3$ are taken out from the solid granular materials a.

Figure 5:
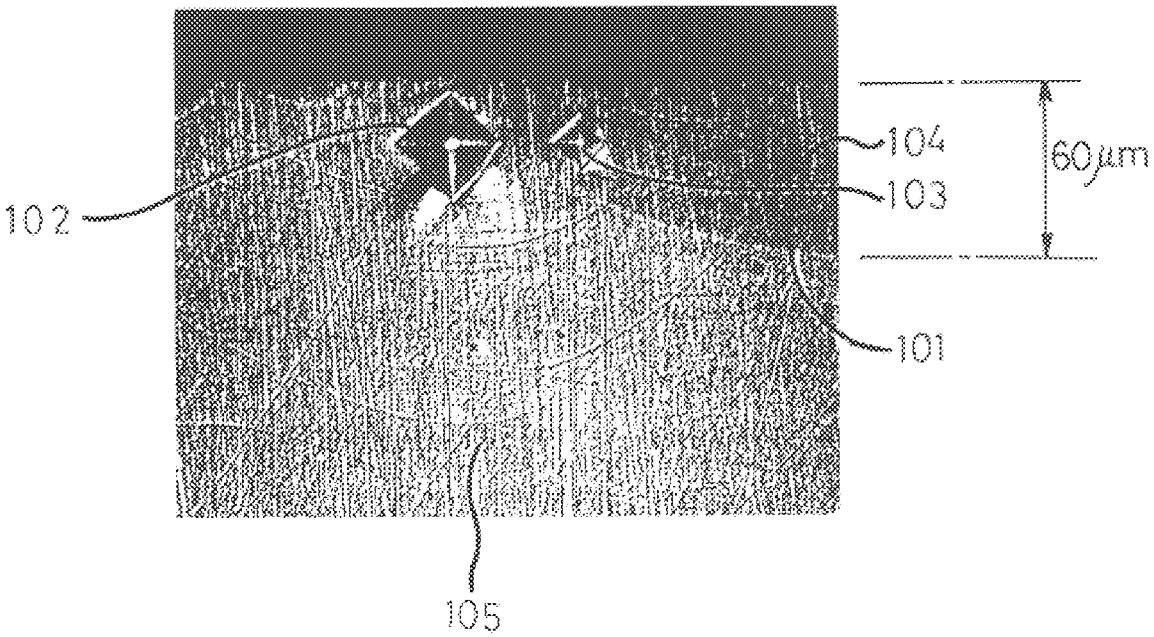
FIG. 5 is a metallurgical microphotograph (magnification 400 times) for showing a metal structure of a layered portion of a nitrided material $W_1$ in the same embodiment.
Figure 6:
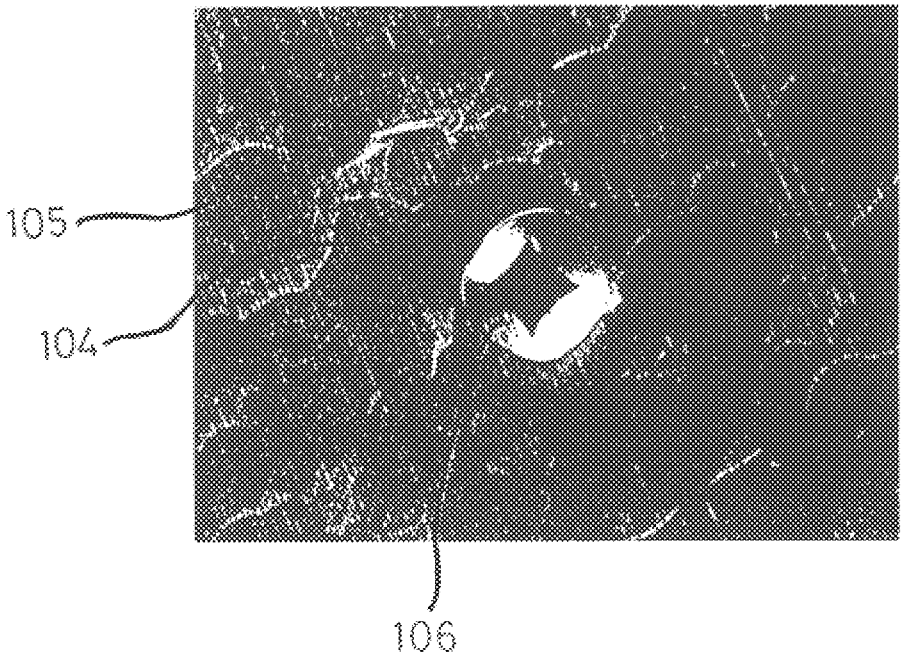
FIG. 6 is a metallurgical microphotograph (Nomarski differential interference photograph: magnification 200 times)for showing a metal structure of a surface portion of a nitrided material $W_1$ in the same embodiment.

FIG. 5 is a metallurgical microphotograph (400 times) at a layered portion of the nitrided material $W_1$ (SUS 304 stainless steel) of the present embodiment, and FIG. 6 is a metallurgical microphotograph (Nomarski differential interference photograph: 200 times) at a surface portion of the nitrided material $W_1$.

First, FIG. 5 is describe. What is called "stain spot" portion 101 is created, and as shown by pressure marks 102, 103 provided for measuring hardness, with respect to the stain spot portion 101 as a border, an area to which the smaller pressure mark 103 belongs is a hardened layer 104, and an area to which the larger pressure mark 102 belongs is a layer 105 with the hardness as in a basic material, which is softer than the hardened layer. The hardened layer 104 extends to 60 $\mu$m in a surface depth, which shows that a nitriding method of the present invention effectively works with respect to a basic material difficult for nitriding.

Also, referring to FIG. 6, a hardened layer 104 is formed in a spot shape. In the same drawing, a pressure mark 106 is provided to an intermediate portion between the hardened layer 104 and a layer 105 with the hardness as in the basic material. It is supposed that a portion where the hardened layer 104 is formed is a portion where the solid granular materials a contact, and a portion 105 where the hardness remains as in the basic material is a portion where the solid granular materials a do not contact. In any case, it is confirmed that the spot patterns of this type can be controlled by adjusting the particle size of the solid granular materials a. It has been found that a nitrided material having the spot patterns of this type has an elasticity in a flat or lateral direction better than that of a nitrided material having a uniformly hardened layer on a whole surface to thereby provide a high toughness and abrasion resistance.

Figure 7:
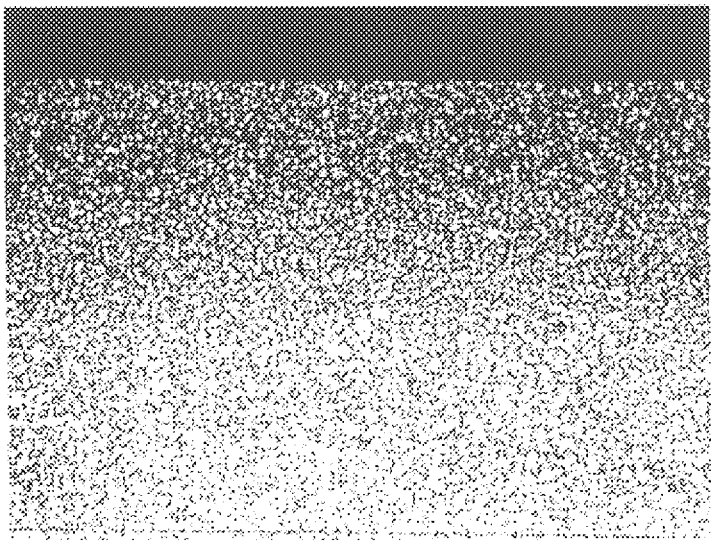
FIG. 7 is a metallurgical microphotograph (magnification 200 times) for showing a metal structure of a layered portion of a nitrided material $W_2$ in the same embodiment.
Figure 8:
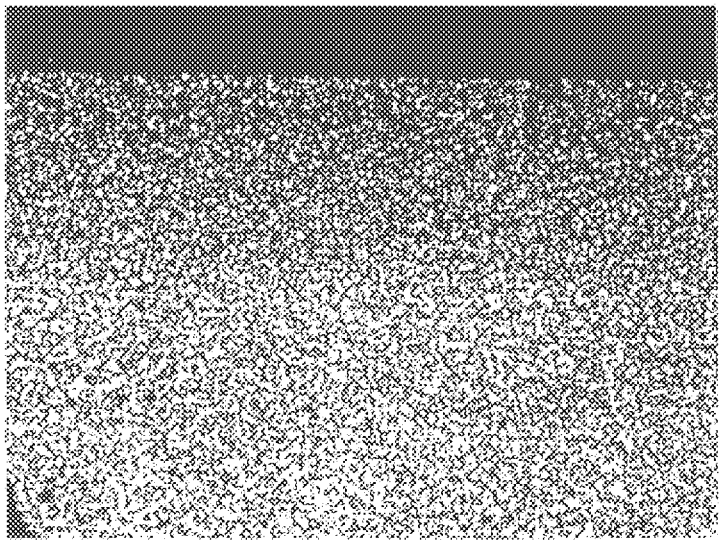
FIG. 8 is a metallurgical microphotograph (magnification 200 times) for showing a metal structure of a layered portion of the nitrided material $W_2$ in the same embodiment.
Figure 9:
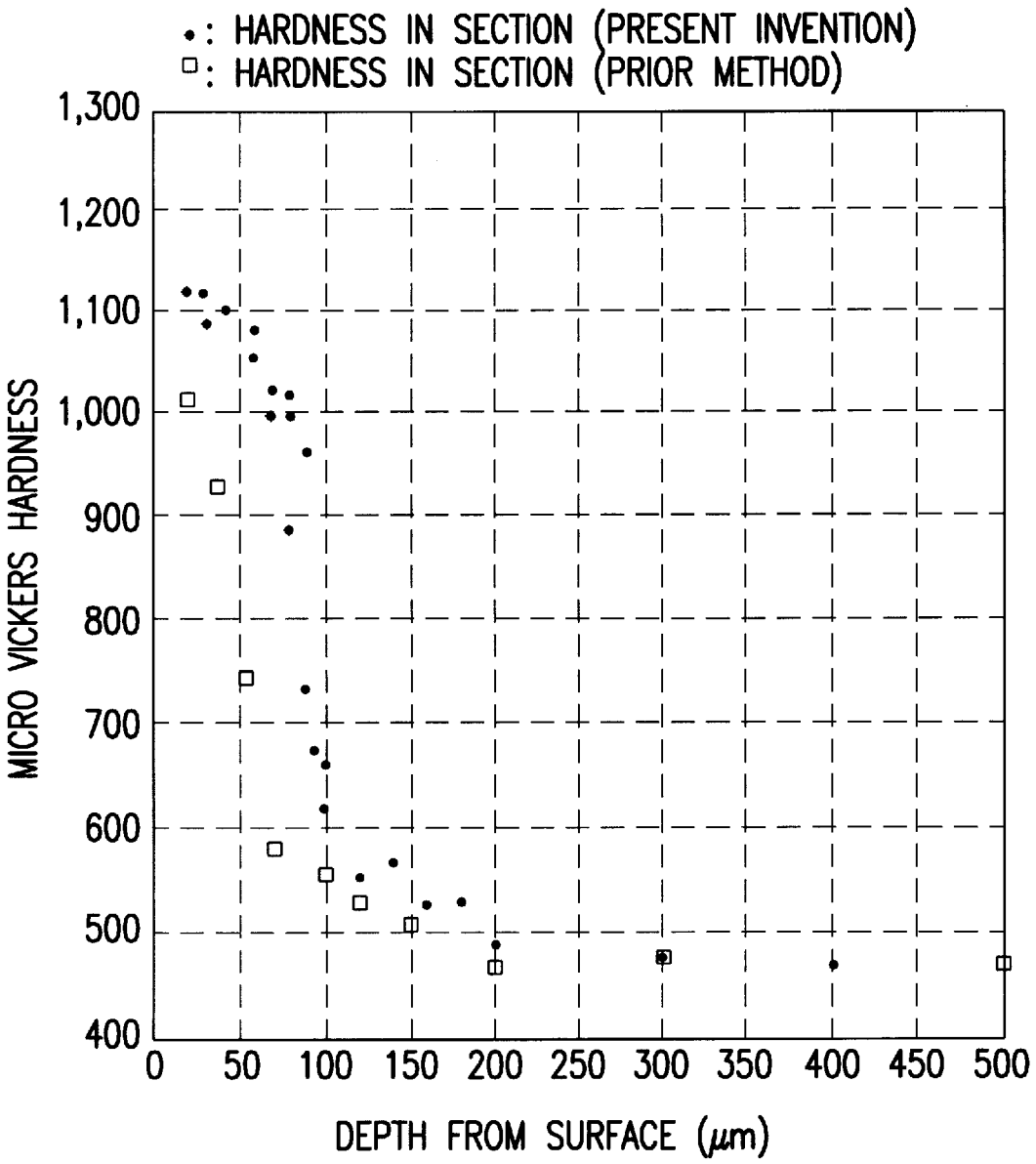
FIG. 9 is a graph plotting characteristics of a nitrided layer of the material $W_2$ shown in FIG. 7 in a relationship of a surface depth and hardness.

Also, FIGS. 7 and 8 show metallurgical microphotographs (200 times) of a layered portion of the nitrided material $W_2$ (SKD 61 hot tool steel) of the present invention. Both the microphotographs correspond to the two materials $W_2$ nitrided at the same time in the sealed box 2, which show that even if they are positioned at different places, uniform treatments can be obtained. These microphotographs prove that the present invention is an excellent method for completely suppressing occurrence of an embrittlement layer (white layer). FIG. 9 is a graph, wherein the depth from a surface is shown in an abscissa, the hardness (micro Vickers hardness) is shown in an ordinate, and a distribution of the hardened layers shown in FIG. 7 is plotted to compare with that of a conventional method. It is apparent from the graph that the hardened layers (which, generally, are defined to be higher than 513 micro Vickers hardness) extend to 200 $\mu$m from the surface, and the hardened layers of the invention generally have a higher hardness compared with those of the conventional method.

Figure 10:
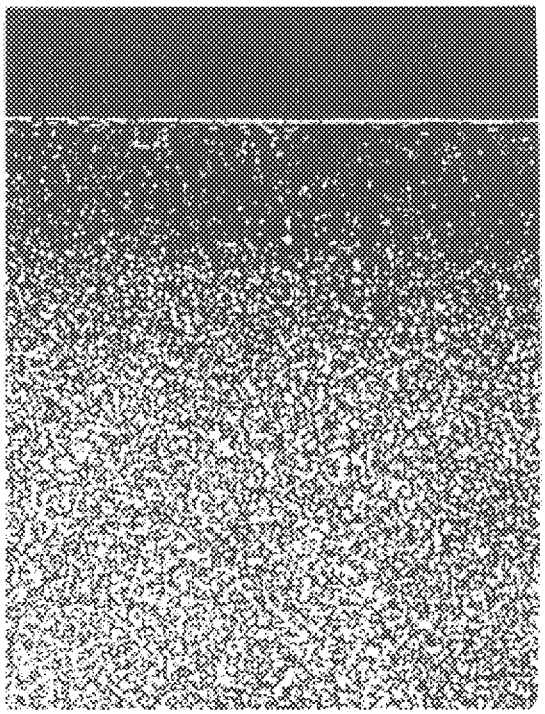
FIG. 10 is a metallurgical microphotograph (magnification 200 times) for showing a metal structure of a layered portion of the nitrided material $W_2$ in the same embodiment.
Figure 11:
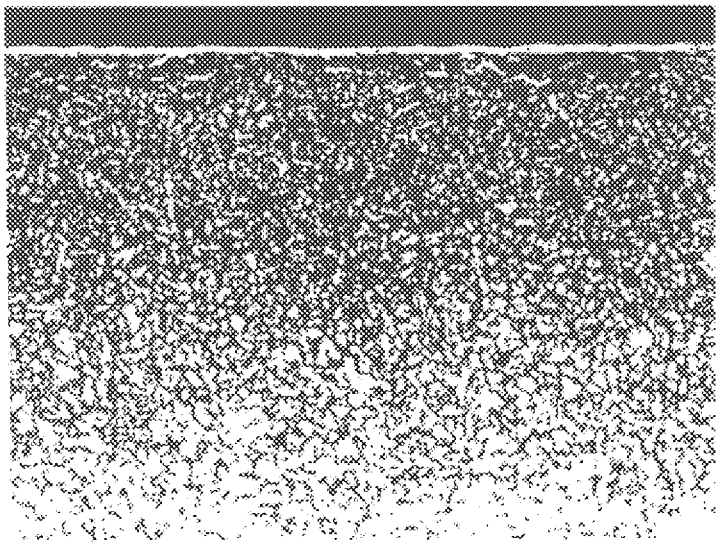
FIG. 11 is a metallurgical microphotograph (magnification 400 times) for showing a metal structure of a layered portion of the nitrided material $W_2$ in the same embodiment.

FIGS. 10 and 11 are metallurgical microphotographs (200 times in FIG. 10; 400 times in FIG. 11) of a layered portion of the same nitrided material $W_2$ (SKD 61 hot tool steel) as those in FIGS. 7 and 8. What is different from FIGS. 7 and 8 is that FIGS. 10 and 11 prove that an extremely thin embrittlement layer (white layer) can be positively formed on the hot tool steel by changing treating conditions in the present invention. The treating conditions include temperature; gas pressure; time; particle size, specific gravity and void ratio of the solid granular materials; quality, shape and mass of the material to be treated; required thickness and hardness of a nitriding hardened layer; and the like. Especially, it is greatly influenced by temperature and time. However, the present invention has a characteristic such that by setting all the treating conditions, the thickness of the embrittlement layer can be more accurately controlled than in the known technique.

Figure 12:
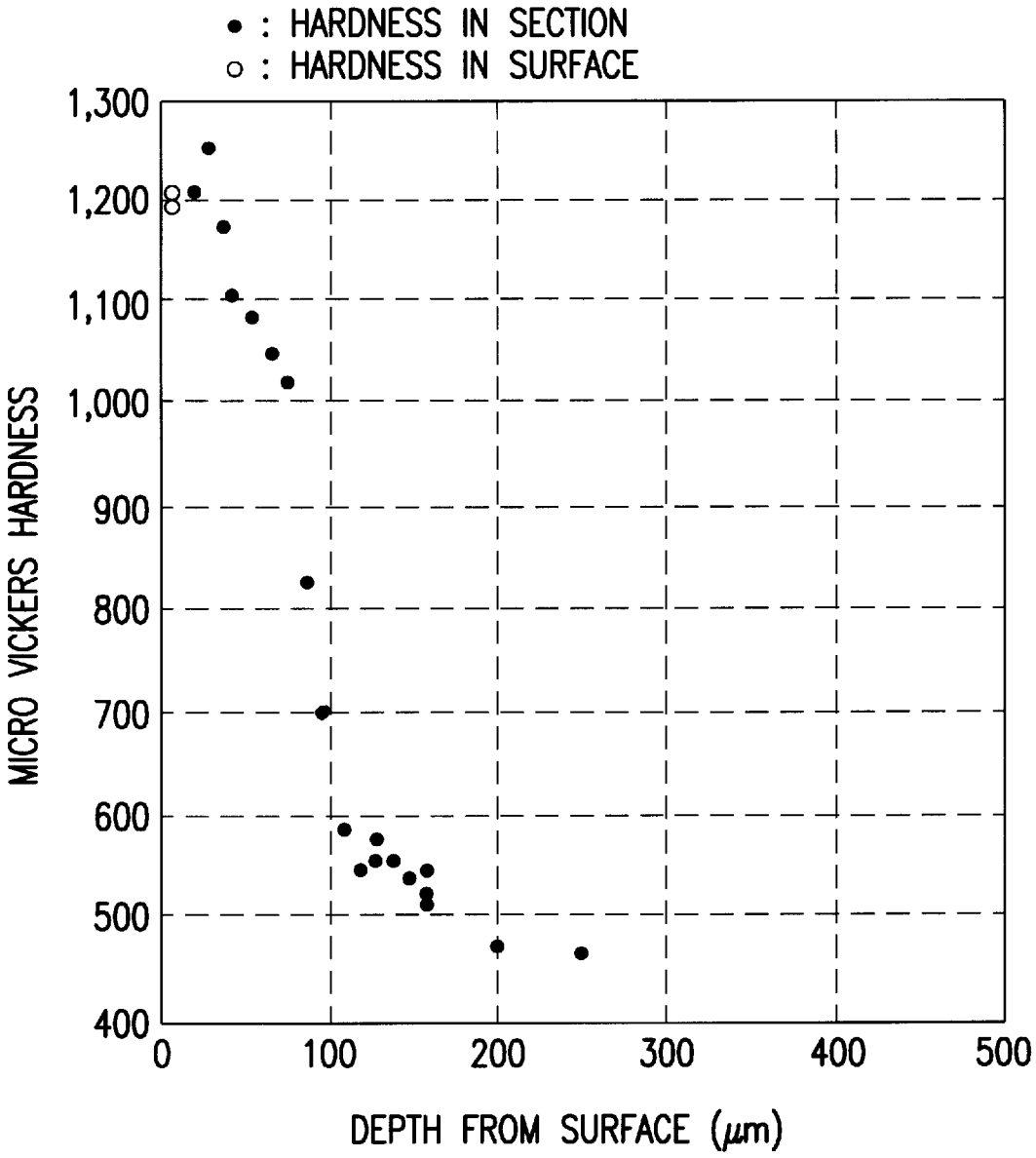
FIG. 12 is a graph plotting characteristics of a nitrided layer of the material $W_2$ shown in FIG. 10 in a relationship of a surface depth and hardness.
Figure 13:
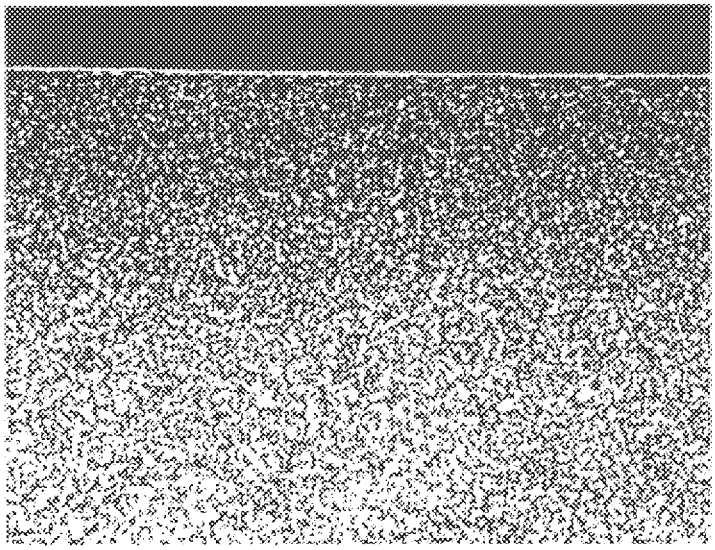
FIG. 13 is a metallurgical microphotograph (magnification 200 times) for showing a metal structure of a layered portion of the nitrided material $W_2$ in the same embodiment.

FIG. 12 is a graph plotting a hardness distribution corresponding to FIG. 9, wherein a most hard layer is formed under an embrittlement layer of 2–3 $\mu$m which has an extremely high strength, and the hardened layer extends to a surface depth of 150 $\mu$m therefrom. It is confirmed through an actual use that if the extremely thin embrittlement layer as described above is formed, although a finishing accuracy of a stamped product is slightly lowered, a life cycle of a die can be extended. Incidentally, FIG. 13 is a metallurgical microphotograph of a layered portion corresponding to FIG. 10, wherein a nitriding was carried out on the same material under the same conditions on a different day, as those of FIG. 10. From these metallurgical microphotographs, it is apparent that the embrittlement layers can be well reproduced and the depth thereof can be arbitrarily controlled.

Figure 14:
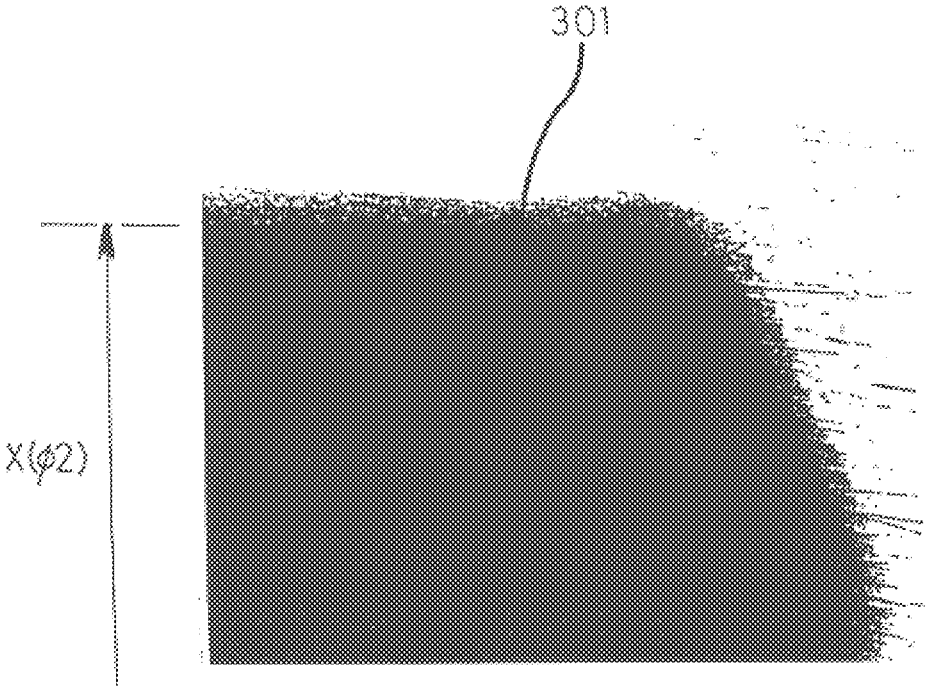
FIG. 14 is a metallurgical microphotograph (magnification 50 times) for showing a metal structure of a layered portion at a center of a small hole of a nitrided material $W_3$ in the same embodiment.
Figure 15:
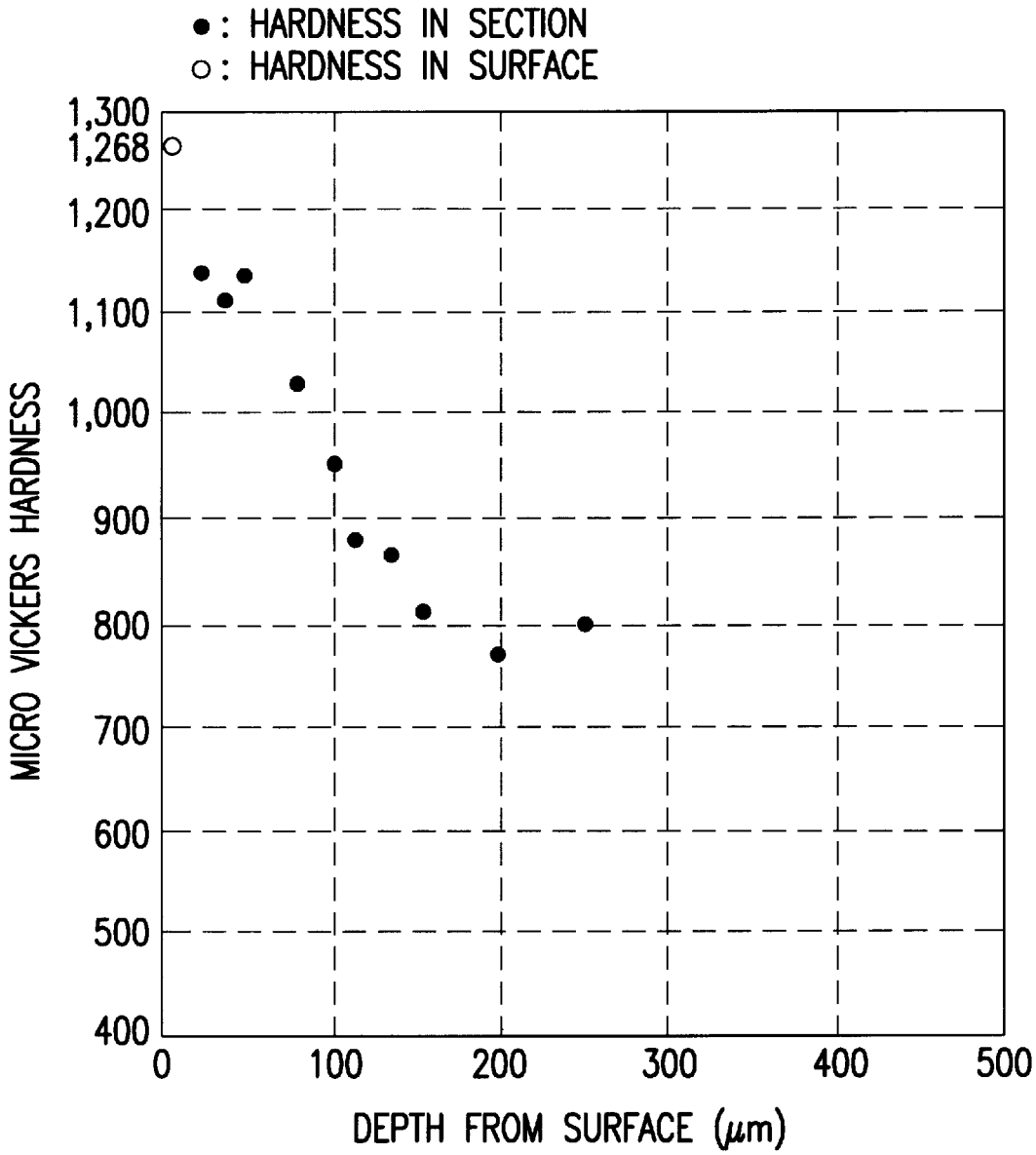
FIG. 15 is a graph plotting characteristics of a nitrided layer of the material $W_2$ shown in FIG. 14 in a relationship of a surface depth and hardness.

FIG. 14 is a metallurgical microphotograph (50 times) of a layered portion at a center of a hole of the nitrided material $W_3$ in the present embodiment. In this microphotograph, as shown in FIG. 5, a "stain spot" portion 301 is also uniformly formed along an inner circumference of the hole X (refer to FIG. 4) in a certain depth. A relationship between the surface depth and the hardness is plotted in FIG. 15. From FIG. 15, it is proved in the present invention that a uniform and effective nitriding proceeds with respect to a part having a small hole, even if the small hole does not penetrate and is ended at a closed inner portion.

Summing up the above, it is assumed that the present invention has the following operations.

First, according to a conventional nitriding method, if a material to be nitrided is placed only in a sealed box and a nitriding gas is supplied to flow therethrough, the introduced nitriding gas just flows over a surface of the material to be nitrided, so that the flow amount distribution of the nitriding gas is liable to become uneven between an upstream side and a down stream side or in a lateral direction perpendicular to the flow. Moreover, in this structure, it is difficult to uniformly transmit heat from a heating source to various portions. It causes delay in the nitriding process or unevenness, and also, there is a disadvantage that a gas consumption is increased.

On the contrary, in case the solid granular materials are filled in the sealed box and a material to be nitrided is disposed therein, the solid granular materials make the nitriding gas to diffuse and form a uniform gas flow and are considered as a medium to uniformly contact the material to be nitrided with the nitriding gas. Also, it is believed that in case the solid granular materials are used, since the surface areas thereof are increased, the surface areas once absorb the nitriding gas and gradually discharge the absorbed nitriding gas, so that the nitriding gas is held around the material to be nitrided with a certain density. Further, the solid granular materials function to provide uniform heat from a heat source, so that after heating, various portions are heated to about the same temperature at the same time. Therefore, it is believed that through such functions of the solid granular materials, a material difficult for nitriding and a materia having a particular shape can be continuously contacted with atomic nitrogen under heating to thereby accelerate a nitriding.

In any case, through the present embodiment, it is confirmed that the present invention is an excellent method, wherein the material difficult for nitriding can be nitrided; the material to be nitrided with the special shape can be uniformly nitrided; and the embrittlement layer can be suppressed or controlled. Also, according to the present method, since a nitriding effectively progresses, a nitriding time can be greatly shortened in comparison with the conventional method; a processing speed is extremely shortened to thereby improve production efficiency; the possibility of increasing the errors occurred when the conditions are set is lowered; and nitrided materials of a high quality can be produced at a high yield.

Also, in the above embodiment, since the inert gas, such as $N_2$ gas, is introduced into the furnace, the difference between the inside and outside pressures in the sealed box is made small, and a pressure resistance of the sealed box, in other words, safety thereof can be increased. Further, by substituting an atmosphere in the furnace with the inert gas, even if a gas enters the sealed box, no influence is exerted on the nitriding effect to thereby improve quality of a product.

Further, in the above embodiment, if necessary, the gas flow may be reversed to introduce and discharge the gas in a pulse state. Therefore, the gas is stirred and made uniform in the sealed box, which results in nitriding evenness and good efficiency. Particularly, the present method is effective for a machine part having a small hole where a gas is liable to stay.

Moreover, in the present invention, a using amount of the nitriding gas, such as $NH_3$, can be reduced to less than one tenths of that in the conventional method, so that contamination of a working environment can be reduced, and safety in case of using a dangerous gas can be raised.

Incidentally, the present invention is not limited to only the above described embodiment. For example, a grain size of the solid granular materials as fillings; temperature of the furnace; a gas pressure, flow amount and decomposition rate of the $NH_3$ gas; a gas pressure, flow amount and holding time of the inert gas and the like can be properly set depending on a purpose and specification of the nitriding, and these should not be specially designated by numerical values. Also, with respect to a nitriding for titanium or stainless steel, it has been found that solid granular materials made of a sintered product of metal and heat resisting ceramics are effective. Further, in the above embodiment, the inert gas was introduced into the furnace, which is a desirable mode due to the above described reasons. However, use of the inert gas is not an essential factor in the present invention depending on a structure and a pressure resisting property of the sealed box. Furthermore, the same is applied to substitution of a gas and shifting of the gas flow in a reverse direction in the sealed box.

As described hereinabove, in the present invention, a material to be nitrided is disposed in the solid granular materials, and the nitriding gas is supplied to flow through the solid granular materials to thereby proceed nitriding of the material. Therefore, formation of the embrittlement layer (white layer) with respect to the material to be nitrided can be effectively suppressed; a material difficult for nitriding, such as austenite, can be nitrided; and a uniform and good nitriding layer can be formed on a material having a special shape, such as an edge and small hole. Through the effects as described above, a stably hardened layer can be formed on a surface of a portion where loss of weight should not occur, so that reliance of the nitrided member can be increased. Also, mixture of portions having high hardness and portions having hardness as in the basic material is presented on the same surface of a material to be nitrided, and a rate of the mixture can be arbitrarily controlled, so that a characteristic excellent in an abrasion resistance can be easily provided. Further, in comparison with the conventional salt-bath nitriding method, a working environment becomes better, and durability of an apparatus can be improved.

What is claimed is:

1. A composite diffusion nitriding method comprising:

preparing solid granular materials in a container, said solid granular materials having an average diameter of several hundreds micrometers to form voids among the solid granular materials, disposing a material to be nitrided in the solid granular materials in the container, heating the material to be nitrided and the solid granular materials in the container, and supplying a nitriding gas to flow through said solid granular materials with the material to be nitrided in the container so that nitriding of the material proceeds uniformly.

2. A composite diffusion nitriding method according to claim 1, further comprising removing air from the container, and providing an inert gas to the container, said heating the material being conducted after the inert gas is supplied to the container.

3. A composite diffusion nitriding method according to claim 2, wherein a void rate in the solid granular materials is about 20%, and a heating temperature is between 400° and 600° C.

4. A composite diffusion type nitriding method according to claim 3, wherein said solid granular materials are made of sintered metals or sintered ceramics, and the nitriding gas is $NH_3$.

5. A composite diffusion nitriding apparatus for nitriding a material, comprising:

a container having solid granular materials therein, said solid granular materials having an average diameter of several hundreds micrometers to form voids among the solid granular materials, a material to be nitrided being adapted to be placed in the solid granular materials in the container;

a furnace for housing said container therein and having a heater for heating the container with the granular materials and the material to be nitrided, and an inert gas introduction path for introducing the inert gas into said furnace;

a nitriding gas introduction path connected to the container, through which a nitriding gas is adapted to be introduced into said container; and an exhaustion path connected to the container for exhausting said nitriding gas from the container so that the material held by the solid granular materials in the container is uniformly nitrided while the nitriding gas flows in the container.

6. A composite diffusion nitriding apparatus according to claim 5, wherein said nitriding gas introduction path includes a plurality of introduction branches connected to a plurality of positions on the container with an interval therebetween, said nitriding gas being selectively introduced into the container from the plurality of positions.

7. A composite diffusion nitriding apparatus according to claim 6, wherein said exhaustion path includes a plurality of exhausting branches connected to a plurality of positions on the container with an interval therebetween, said nitriding gas supplied into the container being selectively exhausted from the plurality of positions.

8. A composite diffusion nitriding apparatus according to claim 5, wherein said nitriding gas introduction path includes a first inlet connected to a nitriding gas source, and a second inlet connected to an inert gas source, an inert gas in the insert gas source being supplied to the container prior to supply the nitriding gas from the nitriding gas source.

9. A composite diffusion nitriding method according to claim 2, wherein said container containing the solid granular materials and the material to be nitrided is placed in a heating furnace; air in the heating furnace is removed at a time of removing air from the container; and an inert gas is supplied to the heating furnace at a time of providing the inert gas to the container.

10. A composite diffusion nitriding method according to claim 9, wherein said nitriding gas is supplied to the container while the inert gas is kept in the heating furnace, a pressure in the heating furnace being greater than an atmosphere outside the heating furnace and less than a pressure of the nitriding gas in the container.

11. A composite diffusion nitriding method according to claim 10, wherein said container includes gas discharge-introduction pipes, said nitriding gas being supplied to the container through one of the gas discharge-introduction pipes and exhausted through the other of the gas discharge-introduction pipes, a gas supply direction by the gas discharge-introduction pipes being changed alternately to uniformly nitride the material in the container.

12. A composite diffusion nitriding apparatus according to claim 5, wherein a void rate in the solid granular materials is about 20%.

* * * * *